US006308764B1

(12) United States Patent
Lin

(10) Patent No.: US 6,308,764 B1
(45) Date of Patent: Oct. 30, 2001

(54) MODULATING MECHANISM OF VENETIAN BLIND

(75) Inventor: Jung-Kuei Lin, Hsinchu (TW)

(73) Assignees: Industrial Technology Research Institute, Hsinchu Hsien; Nien Made Enterprise Co., Ltd., Changhua Hsien, both of (TW)

( * ) Notice: Subject to any disclaimer, the term of this patent is extended or adjusted under 35 U.S.C. 154(b) by 0 days.

(21) Appl. No.: 09/705,884

(22) Filed: Nov. 6, 2000

(30) Foreign Application Priority Data

Oct. 5, 2000 (TW) ..... 89217232 U

(51) Int. Cl.[7] ..... E06B 9/26
(52) U.S. Cl. ..... 160/177 R
(58) Field of Search ..... 160/177 R, 177 V, 160/176.1 R, 176.1 V, 168.1 R, 172 R, 173 R, 107

(56) References Cited

U.S. PATENT DOCUMENTS 3,921,695 * 11/1975 Debs ..... 160/177 R X
4,507,831 * 4/1985 McClure ..... 160/177 R X
4,875,516 * 10/1989 Marocco ..... 160/177 R X
4,955,248 * 9/1990 Lindstrom ..... 160/177 R X
5,002,113 * 3/1991 Georgopoulos ..... 160/176.1 R
5,092,387 * 3/1992 King et al. ..... 160/176.1 R
5,186,229 * 2/1993 Hsu ..... 160/177 R
5,396,945 * 3/1995 Meyer ..... 160/177 R

* cited by examiner

*Primary Examiner*—David M. Purol
(74) *Attorney, Agent, or Firm*—Browdy and Neimark

(57) ABSTRACT

A Venetian blind modulating mechanism comprises a housing, a worm gear pivoted in the housing, and a worm shaft engaged at one end with the worm gear such that other end of the worm shaft is jutted out of the housing. The worm shaft is formed of a link member and an action member connected end to end with the link member. The link member is engaged at one end with the worm gear and is connected at other end with one end of the action member. Other end of the action member is jutted out of the housing to be connected with an adjustment rod of the Venetian blind.

3 Claims, 5 Drawing Sheets

MODULATING MECHANISM OF VENETIAN BLIND

FIELD OF THE INVENTION

The present invention relates generally to a Venetian blind, and more particularly to a modulating mechanism of the Venetian blind.

BACKGROUND OF THE INVENTION

As shown in FIG. 1, a Venetian blind of the prior art comprises an upper rail 1, a lower rail 2, a plurality of cords 3, and a plurality of slats 4 which are held by the cords 3 between the upper rail 1 and the lower rail 2. The slats 4 are folded or unfolded by two pull cords in conjunction with an adjustment rod 5 which is used to actuate a modulating device 6 to set the slats 4 at any angle to regulate the light and the air passing through. The modulating device 6 is disposed in the upper rail 1. In order to prevent the adjustment rod 5 from interfering the slats 4, the worm rod 6*a* of the modulating device 6 is connected at one end of the adjustment rod 5 in such a way that the worm rod 6*a* is slantingly engaged with a worm gear 6*b*. As a result, the adjustment rod 5 and the slats 4 are separated by a distance.

The modulating device 6 of the prior art is defective in design in that the worm rod 6*a* is jutted out of the upper rail 1 such that the worm rod 6*a* is apt to interfere with the slats 4 located in proximity of the upper rail 1 at such time when the slats 4 are drawn up together to the top of the window. In addition, the modulating device 6 complicates the packaging of the Venetian blind. Moreover, the worm rod 6*a* is vulnerable to breakage in the course of transportation of the Venetian blind.

SUMMARY OF THE INVENTION

It is the primary objective of the present invention to provide a Venetian blind modulating mechanism which does not complicate the packaging of the Venetian blind.

It is another objective of the present invention to provide a Venetian blind modulating mechanism comprising a worm rod which can be separated to avert damage in the course of transportation of the Venetian blind.

The modulating mechanism of the present invention comprises a housing in which a worm gear is pivoted such that the worm gear is engaged with one end of a worm shaft. The other end of the worm shaft is jutted out of the housing. The worm shaft is formed of a link member and an action member. The link member is engaged at one end with the worm gear and is connected at other end with one end of the action member. The other end of the action member is jutted out of the housing.

DETAILED DESCRIPTION OF THE INVENTION

Figure 1:
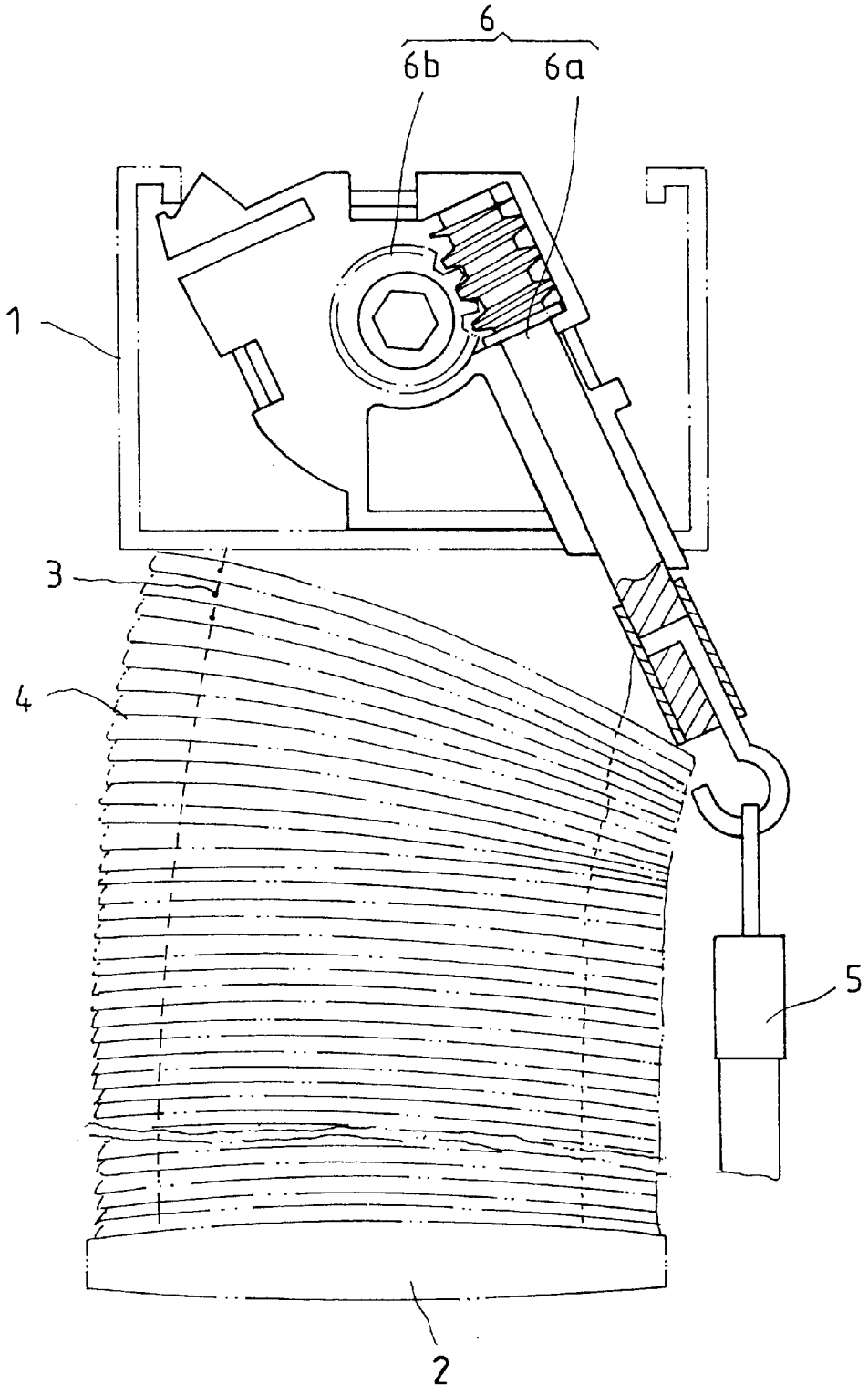
FIG. 1 PRIOR ART
FIG. 1 shows a schematic view of a Venetian blind modulating device of the prior art.
Figure 2:
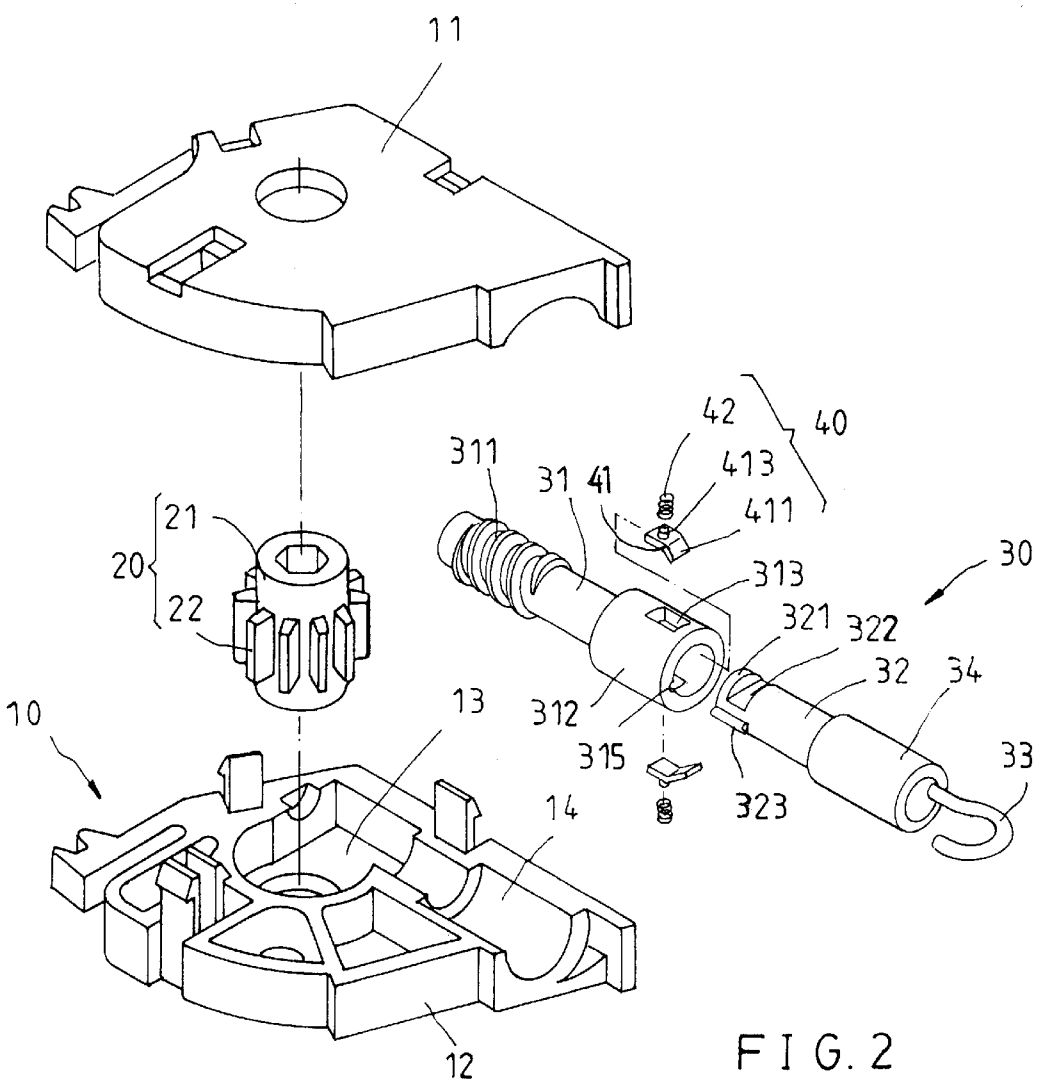
FIG. 2 shows an exploded view of a first preferred embodiment of the present-invention.
Figure 3:
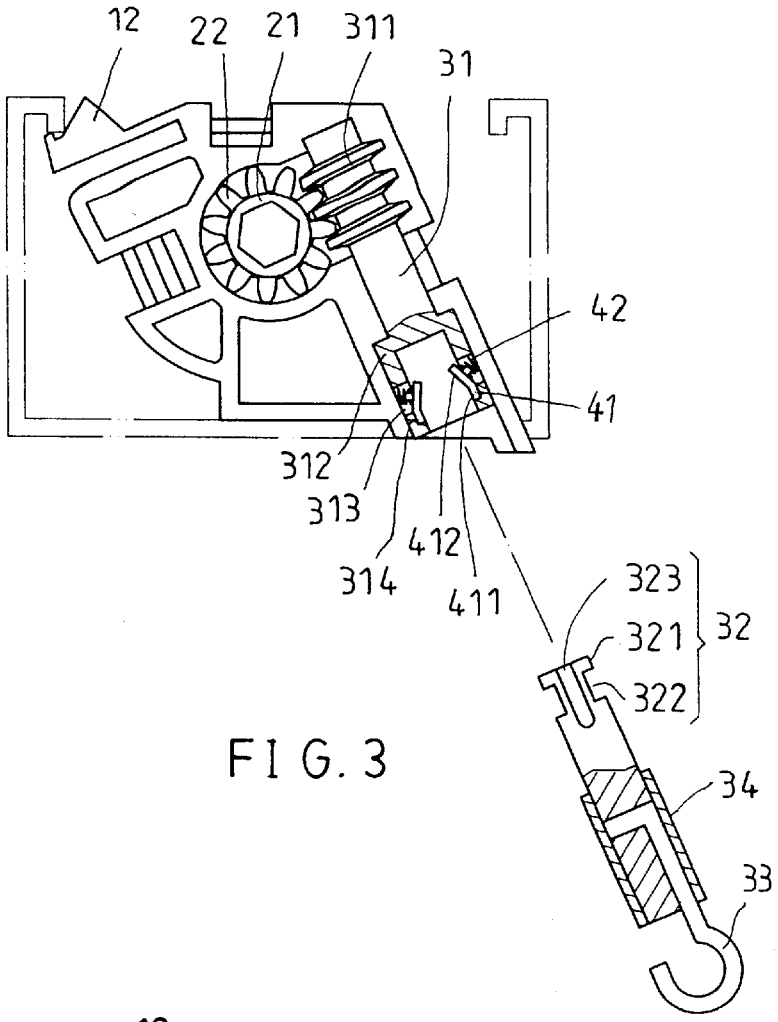
FIG. 3 shows a schematic plan view of a pre-assembly worm shaft set of the first preferred embodiment of the present invention.

As shown in FIGS. 2 and 3, a Venetian blind modulating mechanism of the present invention comprises a housing 10, a gear 20, a worm shaft 30, and two retaining sets 40.

The housing 10 is formed of an upper member 11 and a lower member 12 and is provided therein with a receiving space 13 and a shaft hole 14 in communication with the receiving space 13.

The gear 20 is rotatable in the receiving space 13 of the housing 10 on a spindle 21 which is provided with a toothed midsegment 22.

The worm shaft 30 is formed of a link member 31 and an extension member 32.

The link member 31 is disposed in the shaft hole 14 of the housing 10 and is provided at one end with a worm gear 311, which is meshed with the toothed midsegment 22 of the gear 20. The link member 31 is provided at other end with a tubular portion 312 having two openings 313 symmetrical to each other. The tubular portion 312 is provided in the inner wall with a position confining slot 314 located in proximity of the openings 313. The tubular portion 312 is further provided in the inner wall with a guide slot 315 extending along the longitudinal direction of the tubular portion 312.

The extension member 32 is provided in the front segment with a fitting segment 321 which is fitted into the tubular portion 312 and is provided with two retaining slots 322 and a guide pin 323. As the guide pin 323 slides along the guide slot 315, the retaining slots 322 are corresponding in location to the openings 313. The extension member 32 has a rear segment which juts out of the housing 10 and is provided with a hooked ring 33 which is confined by a movable jacket 34 and is connected with an adjustment rod (not shown in the drawings).

The retaining sets 40 are mounted at the openings 313 of the tubular portion 312 and are formed of a curved retaining piece 41 and a spring 42. The retaining piece 41 has one side 411 which is disposed in the position confining slot 314. The retaining piece 41 has one folded side 412 which is located at the opening 313 and is provided in the back with a protruded pin 413. The spring 42 is disposed in the opening 313 such that one end of the spring 42 urges the inner wall of the housing 10, and that other end of the spring 42 is fitted over the protruded block 413.

Figure 4:
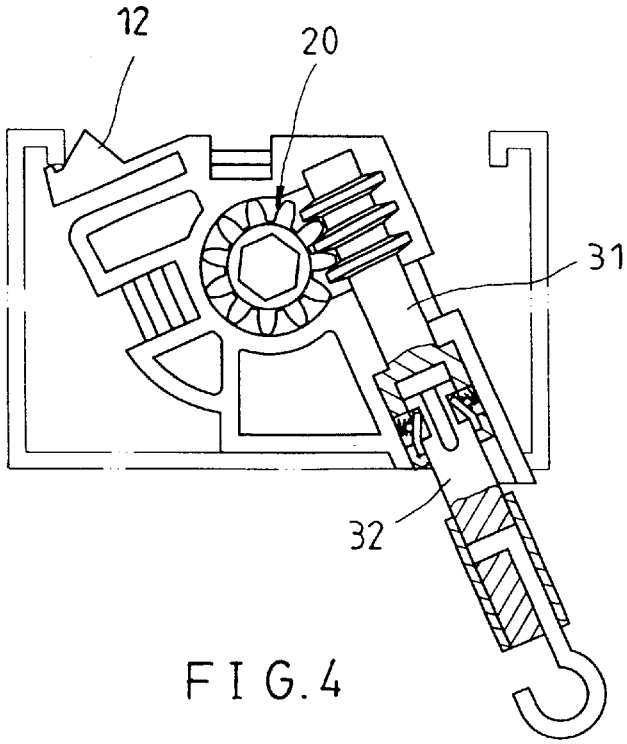
FIG. 4 shows a schematic plan view of a post-assembly worm shaft set of the first preferred embodiment of the present invention.

The link member 31 and the extension member 32 are connected such that the folded side 42 of the retaining piece 41 is engaged in the retaining slot 322, thereby enabling the link member 31 and the extension member 32 to be securely fastened together, as shown in FIG. 4. The worm shaft 30 is regarded as a unitary body.

Figure 5:
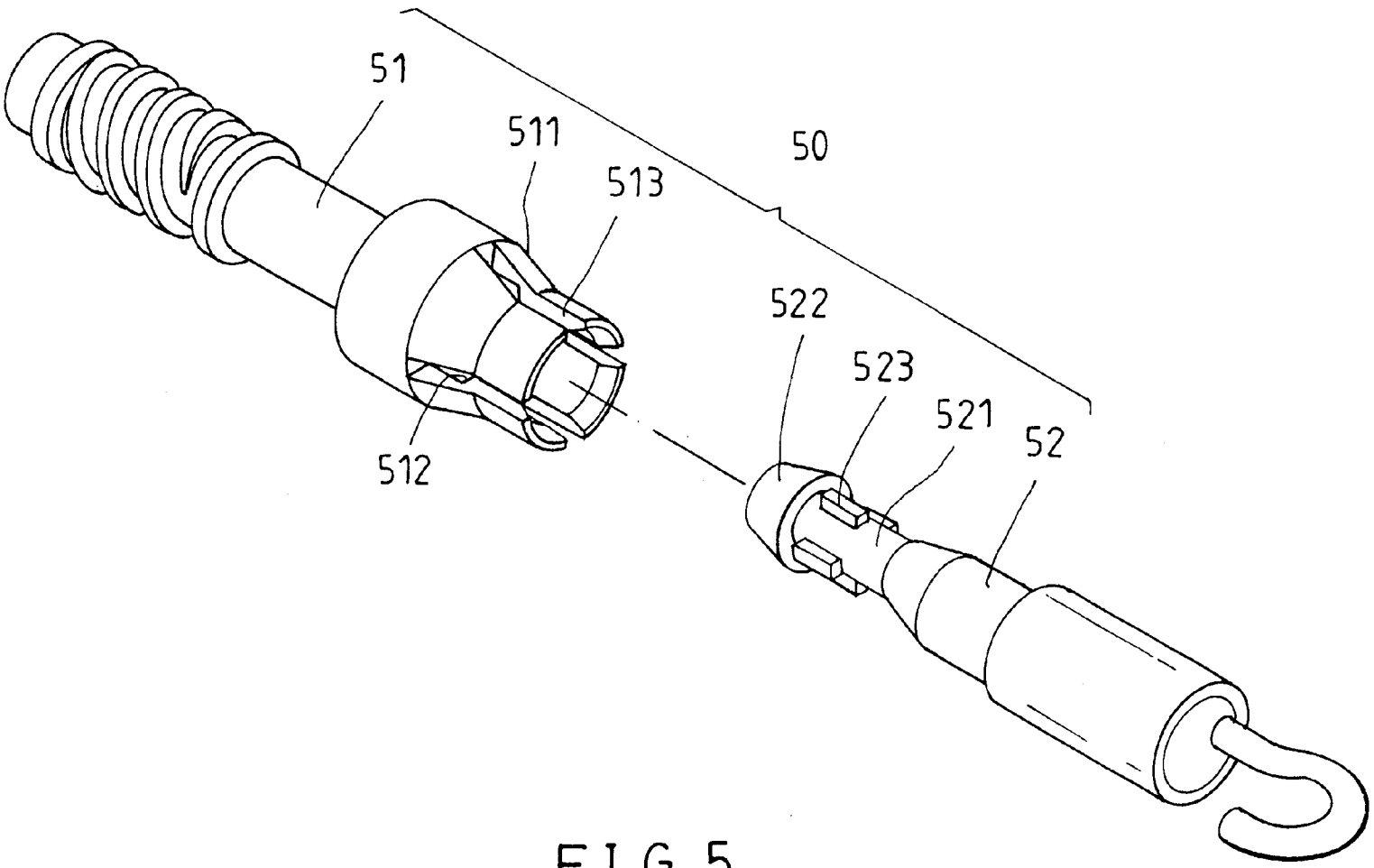
FIG. 5 shows an exploded view of a worm shaft of a second preferred embodiment of the present invention.
Figure 6:
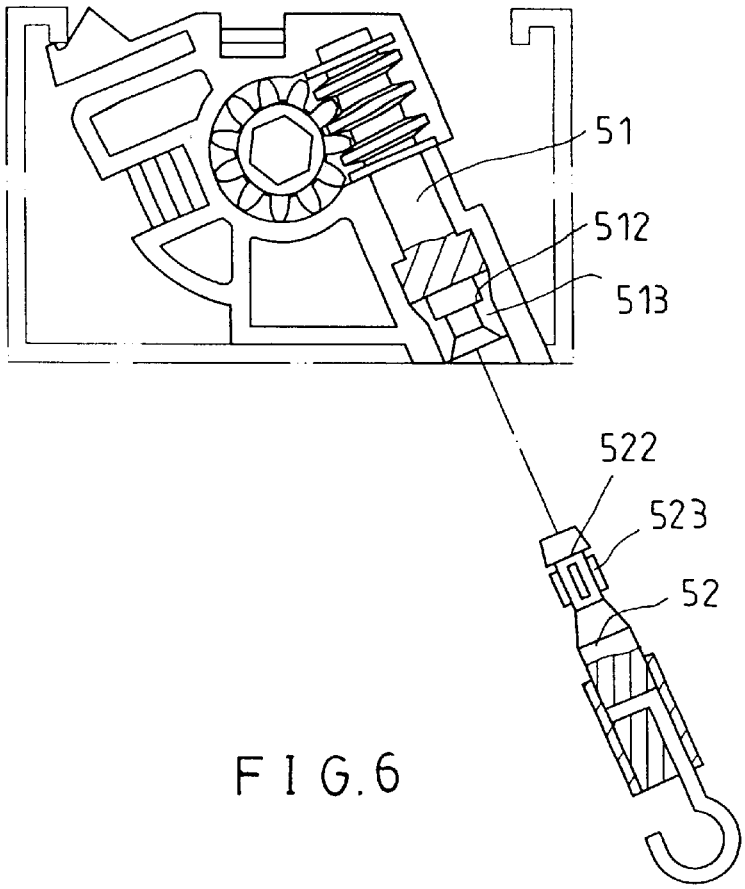
FIG. 6 shows a schematic view of a pre-assembly worm shaft set of the second preferred embodiment of the present invention.

As shown in FIGS. 5 and 6, a worm shaft 50 of the second preferred embodiment of the present invention is formed of a link member 51 and an extension member 52, which are connected end to end. The link member 51 is provided with a tubular portion 511 which is turn provided in the interior with a shoulder 512 and in the inner wall with four section slots 513. The extension member 52 is provided with a fitting portion 521 having a head 522 and four retaining pins

Figure 7:
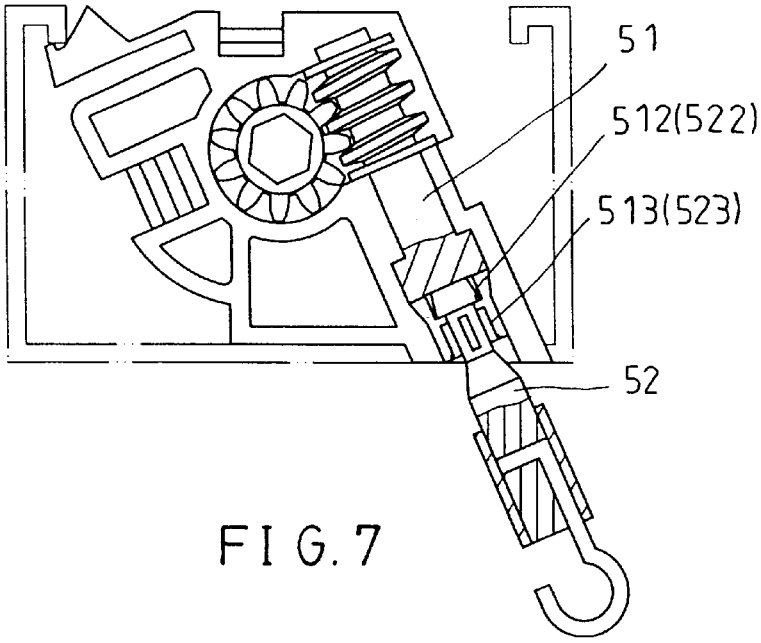
FIG. 7 shows a schematic view of a post-assembly worm shaft set of the second preferred embodiment of the present invention.

523. The fitting portion 521 is fitted into the tubular portion 511 such that the head 522 is rested against the shoulder 512, and that the retaining pins 523 are received in the section slots 513, as shown in FIG. 7. As the extension member 52 is driven by an adjustment rod to turn, the link member 51 is also actuated to turn, thanks to the cooperation of the retaining pins 523 and the section slots 513.

The link members 31 and 51 of the present invention are housed in the housing 10 such that they do not complicate the packaging of the Venetian blind. In addition, the worm shafts 30 and 50 of the present invention can be packaged separately to prevent them from being damaged or severed in the course of transportation of the Venetian blind. Moreover, the action members 32 and 52 of the worm shafts 30 and 50 of the present invention are jutted out of the housing 10 to facilitate the connecting of the worm shaft with an adjustment rod of the Venetian blind.

What is claimed is:

1. A Venetian blind modulating mechanism comprising:

a housing;

a gear rotatably engaged in the housing;

a worm shaft having a link member engaged to an extension member;

a first free end of the link member having worm gear engaged to the gear;

a second end of the link member having a tubular portion provided with at least one opening;

a retaining piece and a spring located in said opening;

a first end of the extension member having a fitting portion;

a second free end of the extension member extending out of the housing;

said fitting portion having at least one retaining slot; wherein when said fitting portion is engaged in the tubular portion the retaining piece is urged by said spring to engage in said retaining slot of the fitting portion.

2. The Venetian blink modulating mechanism as defined in claim 1, wherein said tubular portion of said link member is provided in an inner wall with a guide slot; wherein said fitting portion of said action member is provided with a guide pin whereby said guide pin engages in said guide slot.

3. A Venetian blind modulating mechanism comprising:

a housing;

a gear rotatably engaged in the housing;

a worm shaft having a link member engaged to an extension member;

a first free end of the link member having a worm gear engaged to the gear;

a second end of the link member having a tubular portion;

a first end of the extension member having a fitting portion;

a second free end of the extension member extending out of the housing;

said tubular portion of said link member being provided in an interior thereof with a shoulder, and in an inner wall thereof with a plurality of section slots;

said fitting portion of said extension member having a head and a plurality of retaining pins; wherein said extension member is engaged to said link member such that said fitting portion of said action member is fitted into said tubular portion of said link member, and said head of said fitting portion of said extension member engaged against said shoulder of said tubular portion of said link member, and that said retaining pins of said fitting portion of said action member are received in said section slots of said tubular portion of said link member.

* * * * *